United States Patent [19]

Culley

[11] Patent Number: 4,646,077

[45] Date of Patent: Feb. 24, 1987

[54] VIDEO DISPLAY CONTROLLER SYSTEM WITH ATTRIBUTE LATCH

[75] Inventor: Paul R. Culley, Houston, Tex.

[73] Assignee: Texas Instruments Incorporated, Dallas, Tex.

[21] Appl. No.: 571,047

[22] Filed: Jan. 16, 1984

[51] Int. Cl.[4] ..... G09G 3/16

[52] U.S. Cl. ..... 340/748; 340/750; 340/735; 340/799; 340/723

[58] Field of Search ..... 340/799, 723, 703, 735, 340/750, 748

[56] References Cited

U.S. PATENT DOCUMENTS

| | | | |
|---|---|---|---|
| 4,189,743 | 2/1980 | Schure et al. | 340/799 |
| 4,206,457 | 6/1980 | Weisbecker et al. | 340/799 |
| 4,462,028 | 7/1984 | Ryan et al. | 340/799 |
| 4,504,828 | 3/1985 | Couper et al. | 340/735 |
| 4,520,356 | 5/1985 | O'Keefe et al. | 340/750 |

*Primary Examiner*—Gerald L. Brigance

*Attorney, Agent, or Firm*—Thomas G. Devine; Leo N. Heiting; Melvin Sharp

[57] ABSTRACT

The present invention relates to a video display controller system which permits a variety of differing video attributes for each displayed character. A character code is stored in a character memory and an attribute code is stored in an attribute memory at corresponding memory locations for each display position. In accordance with the present invention the transfer of data to and from the attribute memory is through an attribute latch. Each time a character is written into the character memory the attribute stored in the attribute latch is stored in the corresponding location in the attribute memory. Similarly, the attribute stored in the corresponding location of the attribute memory is stored in the attribute latch upon reading a character from the character memory. The attribute latch can be independently read out or written into. This technique is advantageous for specifying a display screen in which many characters have the same video attribute and for executing block moves within the display screen.

7 Claims, 7 Drawing Figures

VIDEO DISPLAY CONTROLLER SYSTEM WITH ATTRIBUTE LATCH

BACKGROUND OF THE INVENTION

The present invention relates to video display controller systems which are typically employed in small computer systems, terminals and word processors. This invention relates to a manner for reducing data processing overhead and increasing the rate of data transfer pertaining to video characters having associated video attributes.

In the prior art a small computer, terminal or word processing system employs a read/write memory which determines the individual alphanumeric characters displayed upon a video display screen. Typically in such a prior art system, a particular memory location stores a character code corresponding to the alphanumeric character to be displayed at a corresponding location on the video display screen. By changing the contents of a particular memory location, the alphanumeric character displayed at the corresponding position on the video display screen may be changed.

Prior art systems also enable a particular character appearing on the video display screen to have one or more video attributes. These video attributes are employed for special emphasis or visual attention. These video attributes may include various character intensities, character colors, character enable or disable, reverse video, underline and blinking. When a character is enabled it has a foreground/background pattern indicative of the character. When a character is disabled, it is displayed as all background. In reverse video, the foreground and background are reversed. That is, the background is illuminated and the foreground is dark. In an underline mode, the displayed character includes an underline. In a blinking mode, the character remains the same but is periodically turned on and off. In accordance with the prior art, a single character may include more than one of these video attributes, such as a character may be in reverse video or blinking or underlined at the same time.

In accordance with the prior art, a video attribute is stored corresponding to each stored character code for the alphanumeric characters to be shown on the video display screen. This video attribute code carries information concerning the attributes of this particular character which is employed to generate the video signal. In prior art systems, this video character code is read or written at the same time the corresponding character code is read or written. Thus, in order to transfer the data corresponding to an entire screen of alphanumeric text having the same video attributes, it would be necessary to respecify the video attributes each time that an alphanumeric character code is written into the memory.

SUMMARY OF THE INVENTION

The present invention relates to small computer systems, terminals or word processing units in which video character data and video attribute data are stored in memory locations corresponding to a particular screen location in a video display screen. That is, each character location in the video display screen has a portion of memory associated therewith in which is stored a character code defining the character to be displayed at that screen location and an additional portion of memory associated therewith at which a video attribute code is stored. This video attribute code provides an indication of the video attributes of the character to be displayed at that particular screen location.

The present invention includes a video attribute latch which is employed in reading from and writing into the portion of the memory used to store the video attribute codes. In accordance with the present invention, each time that a character code is read from the character memory where the character codes are stored, the corresponding attribute code is written into the video attribute latch. Similarly, each time that a character code is written into a particular character memory location corresponding to a specific screen location, the data stored within the video attribute latch is written into the attribute memory location dedicated to storing the video attributes of the character to be displayed at that particular screen location. This video attribute latch may be read from or written into independent of access to the character code portion of the memory.

This feature is technically advantageous because it enables specification of screen characters and attributes with the storage and transfer of less data then would ordinarily be required. In a typical situation, the video attributes of displayed alphanumeric characters within a particular displayed screen would not differ for every differing character. Instead, the video attribute would change only relatively infrequently. For example, a single line, out of perphaps 25 displayed lines, may be displayed in reverse video for emphasis. Or, for example, the intensity of the particular items selected in a menu may be changed to indicate the items of the menu selected. In such an event, it is not necessary using the present invention to transmit the attribute code with each character code when the particular screen data is specified. Instead, the attribute code is loaded only when the video attribute of the next specified character code differs from that of the previously specified character code. Therefore, for example, the program could specify a number of lines of text with a first video attribute, change modes by loading a new video attribute code into the video attribute latch, specify a few characters or a few lines with this new video attribute code, and then return to the previous attribute code for the rest of the screen. In this case, the character codes for the entire screen have their specified video attribute codes, but the video attribute code only needed to be transmitted at the beginning and end of the alphanumeric characters having the special video attribute code. Thus an application program needs to store and transfer much less data in order to specify the character code and corresponding video attribute code for each screen location.

The provision of reading out the video attribute code corresponding to the same screen location when a character code is read out is useful in other applications. Firstly, this enables the video attribute code corresponding to a particular screen location to be read out and temporarily stored in the video attribute latch when any character code is read. This feature may be used together with the feature of writing into the video attribute memory from the video attribute latch in order to implement block moves of alphanumeric characters without changing their video attributes. If each character code is first read from its original position and then written into its new position, the video attribute logic automatically reads out the corresponding video attribute code from the old location and then writes into the memory the video attribute code corresponding to the new location. In such an event, it is never necessary for the program to read or write the attribute code. This results in a consequent reduction of data transfer between the processor and the video display controller system.

BRIEF DESCRIPTION OF THE DRAWINGS

The above noted aspects of the present invention as well as other features covered by this invention will now be more fully described below when taken in conjunction with the following figures in which.

DETAILED DESCRIPTION OF THE PREFERRED EMBODIMENT

Figure 1:
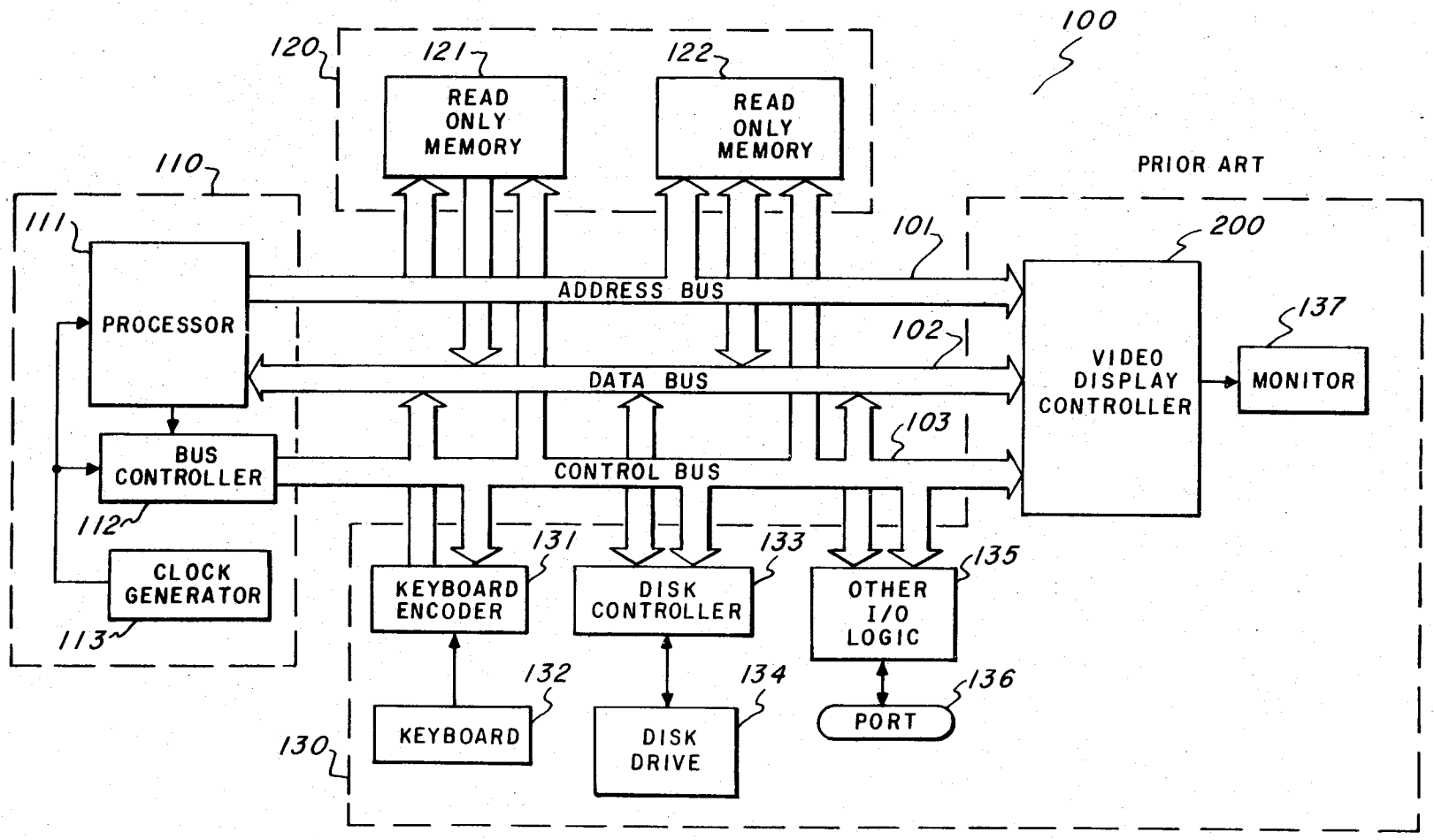
FIG. 1 illustrates the architecture of a prior art data processing system such as may employ the video attribute latch of the present invention.

As stated above, the present application is applicable to small computing systems, terminals and word processing equipment. FIG. 1 illustrates the architecture of such a data processing system as known in the prior art. Data processing system 100 includes address bus 101, data bus 102 and control bus 103 which carry the data flowing between various parts of the apparatus. Data processing apparatus 100 includes processor subsection 110, memory subsection 120 and input/output subsection 130.

Processor subsection 110 includes processor 111, bus controller 112 and clock generator 113. Processor 111 is preferably a single integrated circuit microprocessor such as an Intel 8088. Processor 111 serves as the major data processing element of data processing system 100 and operates under program control in order to perform desired arithmetic and logic functions. Processor 111 is connected to bus controller 112 which generates the signals needed on control bus 103 in order to control the various other portions of data processing system 100. Clock generator 113 is coupled to both processor 111 and bus controller 112. Clock generator 113 serves as the basic timing source for data processing system 100 and controls the speed and timing of operation of processor subsection 110.

Memory subsection 120 includes read only memory 121 and read/write memory 122. Read only memory 121 preferably includes at least some fundamental operating instructions for execution by processor 111 to enable digital computing system 100 to power up and cooperate with various portions of input/output subsystem 130. Thus, for example, the program code stored within read only memory 121 may include the fundamental program code for interpretation of signals from keyboard encoder 131, the fundamental program code for reading or writing data into disk drive 134 via disk controller 133, or the fundamental program code necessary for causing video display controller 200 to generate a desired video display on monitor 137. In addition, it is also considered desirable to place within read only memory 121 a diagnostic self test routine which causes processor 111, under control of this portion of program code stored within read only memory 121, to perform numerous self diagnostic functions upon initial application of electrical power. Lastly, read only memory 121 may optionally include program code for application programs for digital computing system 100 and may further optionally include a computer language interpreter which enables a high level language to be executed via processor 111.

Memory subsection 120 further includes read/write memory 122. Read/write memory 122 provides processor subsection 110 with a reusable memory for storing temporarily used program code and data for manipulation via processor subsection 110. Typically, an applications program or data may be stored on a disk which is read via disk drive 134 in conjunction with disk controller 133. This program code or data is then temporarily stored within read/write memory 122, which is then employed to control the data manipulation operations of processor subsection 110.

Data processing system 100 further includes input/output subsection 130. Input/output subsection 130 includes keyboard encoder 131, keyboard 132, disk controller 133, disk drive 134, other input/output logic 135, input/output port 136, video display controller 200 and monitor 137.

Keyboard encoder 131 and keyboard 132 provide the major form of manual input into digital computing system 100. Keyboard 132 typically includes a standard manual keyboard laid out in the QWERTY format which is familiar to typists and computer terminal operators. Depression of one of the keys of keyboard 132 causes keyboard encoder 131 to transmit an encoded signal on data bus 102 corresponding to the depressed key. Processor subsection 110 in conjunction with program codes stored within read only memory 121 then interprets this signal and then takes further action specified by the application program. By this means the operator is permitted to make manual entries into digital computing system 100 for example for entering new programs, entering data required by an application program or for selecting options within an application program.

Disk controller 133 and disk drive 134 provide a nonvolatile memory for digital computing system 100. Typically read/write memory 122 is formed of dynamic memory, that is, the correct data is retained only so long as electric power is applied. In this instance, when digital computing system 100 is turned off all data stored within read/write memory 122 is lost. Disk controller 133 and disk drive 134 enable digital computing system 100 to permanently store programs or data on a nonvolatile magnetic media such as a floppy disk. Thus, programs entered into digital computing system 100 and data generated by digital computing system 100 may be permanently stored. In addition, digital computing system 100 is typically useful in a great number of particular applications. Typically, the total capacity of read/write memory 122 provided in such a digital computing system is much less than the memory capacity necessary to store all desirable application programs. In such an event, application programs are provided on individual disks which are read into digital computing system 100 via disk drive 134 and disk controller 133 as desired by the user. A new disk is employed to write over the program code and data stored within read/write 122 when the user desires another application program.

Digital computing system 100 includes other input-/output logic 135 and input/output port 136. Other input/output logic 135 and input/output port 136 enable digital computing system 100 to communicate with and respond to additional devices such as printers, communications devices for communication with other computing systems, and additional useful machines.

Input/output subsection 130 includes video display controller 200 and monitor 137. The video display controller 200 responds to signals from processor subsection 110 on address bus 101, data bus 102 and control bus 103 to generate a signal to monitor 137 which specifies a desired video display. The video display appearing on monitor 137 provides the major output of digital computing system 100. In a typical application, video display controller 200 provides a signal to monitor 137 in order to display multiple lines of alphanumeric text upon the screen of monitor 137. In a typical application, each individual alphanumeric character displayed upon monitor 138 is provided with a desired video attribute by video display controller 200. These video attributes may include a variety of intensity levels or colors, a character enable or disable, a reverse video option in which the foreground and background of the character are reversed, a blink option and an underline option. The operation of the video display controller 200 in conjunction with the video attribute latch of the present invention is more fully described below in conjunction with the description of FIG. 2.

In the preferred embodiment the character codes and attribute codes are formed as follows. The character codes are preferably as specified by the ASCII standard character code set. The attribute codes are preferrably formed of eight bits as specified in Table 1 with bit 0 being the least significant bit and bit 7 the most significant bit.

TABLE 1

| | |
|---|---|
| Bit 0 | Color/Intensity Level 1 (Blue) |
| Bit 1 | Color/Intensity Level 2 (Red) |
| Bit 2 | Color/Intensity Level 3 (Green) |
| Bit 3 | Character Enable |
| Bit 4 | Reverse Video |
| Bit 5 | Underline |
| Bit 6 | Blink |
| Bit 7 | Alternate Character Set |

Table 2 indicates the various colors and intensities corresponding to the eight states of the color/intensity bits (bits 0 to 2).

TABLE 2

| Bit 0 | Bit 1 | Bit 2 | Color | Intensity |
|---|---|---|---|---|
| 0 | 0 | 0 | Black | 0 |
| 1 | 0 | 0 | Blue | 1 |
| 0 | 1 | 0 | Red | 2 |
| 1 | 1 | 0 | Magenta | 3 |
| 0 | 0 | 1 | Green | 4 |
| 1 | 0 | 1 | Cyan | 5 |
| 0 | 1 | 1 | Brown | 6 |
| 1 | 1 | 1 | White | 7 |

Figure 2:
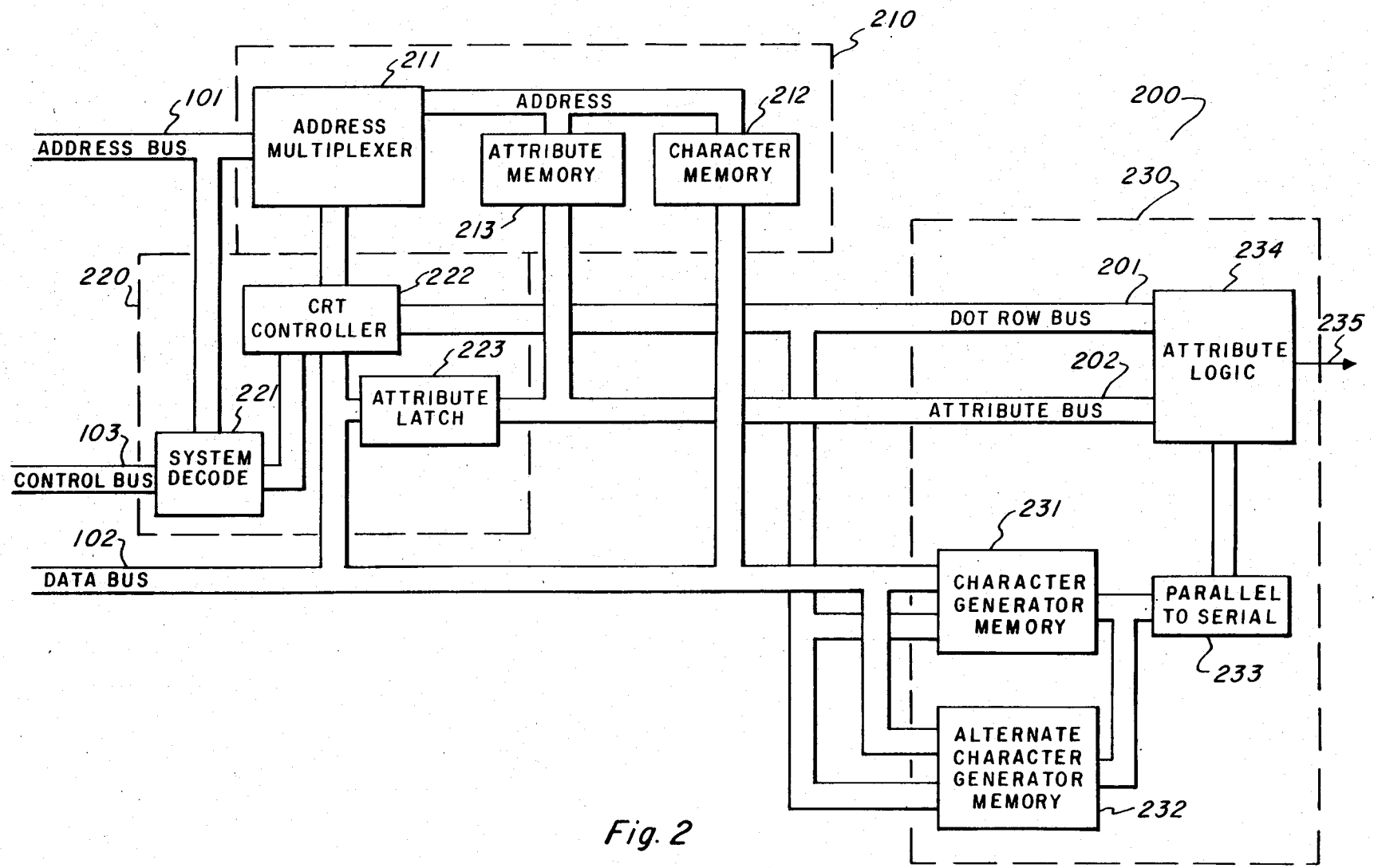
FIG. 2 illustrates an embodiment of the video display controller of the present invention showing the video attribute latch.

FIG. 2 illustrates the preferred embodiment of the construction of video display controller 200 illustrated in FIG. 1. Video display controller 200 illustrated in FIG. 2 receives address data and control signals from other portions of data processing system 100 via address bus 101, data bus 102 and control bus 103, respectively. Video display controller 200 includes three primary subsections. These are the memory subsection 210, the control subsection 220 and the video signal generator subsection 230.

Memory subsection 210 of video display controller 200 includes address multiplexer 211, character memory 212 and attribute memory 213. Address multiplexer 211 operates in order to allow alternate memory access to character memory 212 and attribute memory 213 via either control subsection 220 or processor subsection 110 (shown in FIG. 1). In the normal case, control subsystem 220, with the cooperation of address multiplexer 211, enables recall of character data stored in character memory 212 together with recall of the corresponding attribute data from attribute memory 213 for application to video signal generator subsystem 230. This enables video signal generator subsystem 230 to generate the video display signals in accordance with the contents of character memory 212 and attribute memory 213. At other times, address multiplexer 211 enables processor subsystem 110 to address character memory 212 and attribute memory 213. This may occur if it is desired to change the characters stored within character memory 212, and hence change the characters displayed via monitor 137, or to read from character memory 212 the character data already stored there. In addition, in accordance with the present invention, processor subsystem 110 may either read from or write into attribute memory 213 via video attribute latch 223. This will be described more completely below.

Control subsystem 220 includes video display controller system decoder logic 221, CRT controller 222 and attribute latch 223. Video display controller system decode logic 221 is connected to address bus 101 and control bus 103. Video display controller system decode logic 221 reads the control and address signals from their respective busses and controls the access to character memory 212 and attribute memory 213. In the event that processor subsection 110 has requested access to one of these memories, CRT system decode logic 221 permits this access unless it would interfere with the access to character memory 212 and attribute memory 213 required for screen update. In such an event, video display controller system decode logic 221 places this memory access request on hold until such time as it will not interfere with the screen update.

CRT controller 222 receives a control signal from video display controller system decode logic 221. CRT control 222 applies a character read address to address multiplexer 221 and also generates an indication of the particular dot row within the character displayed which is in synchronism with the particular line scanned by the video display screen. This dot row information is applied to various portions of video signal generator subsection 230 via dot row bus 201.

Video signal generator subsection 230 includes character generator memory 231, alternate character generation memory 232, parallel to serial converter 233, attribute logic 234 and video output 235.

Video signal generator subsection 230 receives character and attribute data from memory subsection 210 in the order in which the characters appear on a particular line. In conjunction with the dot row data on dot row bus 201, character data from character memory 212 is applied to character generator read only memory 231 for recall of the particular dot pattern for that character for the designated dot row. In the alternative, in conjunction with Bit 7 of the corresponding attribute code recalled from attribute memory 213, the particular dot pattern of an alternate character stored in alternate character generator memory 232 is applied to parallel to serial converter 233 and hence to attribute logic 234. In addition, the corresponding attribute code recalled from attribute memory 213 is applied to attribute logic 234 via attribute data bus 202. Attribute logic 234 receives the serial data from parallel to serial converter 233 corresponding to the particular row information of a desired character together with the video attribute data from attribute memory 213 via attribute data bus 202. Together with the dot row data received from dot row bus 201, attribute logic 234 generates the video signal having the characters specified by the character data recalled from character memory 212 and the video attributes specified by the attribute code recalled from attribute memory 213. This signal is then applied to video output 235 for application to monitor 137 (illustrated in FIG. 1).

Figure 3:
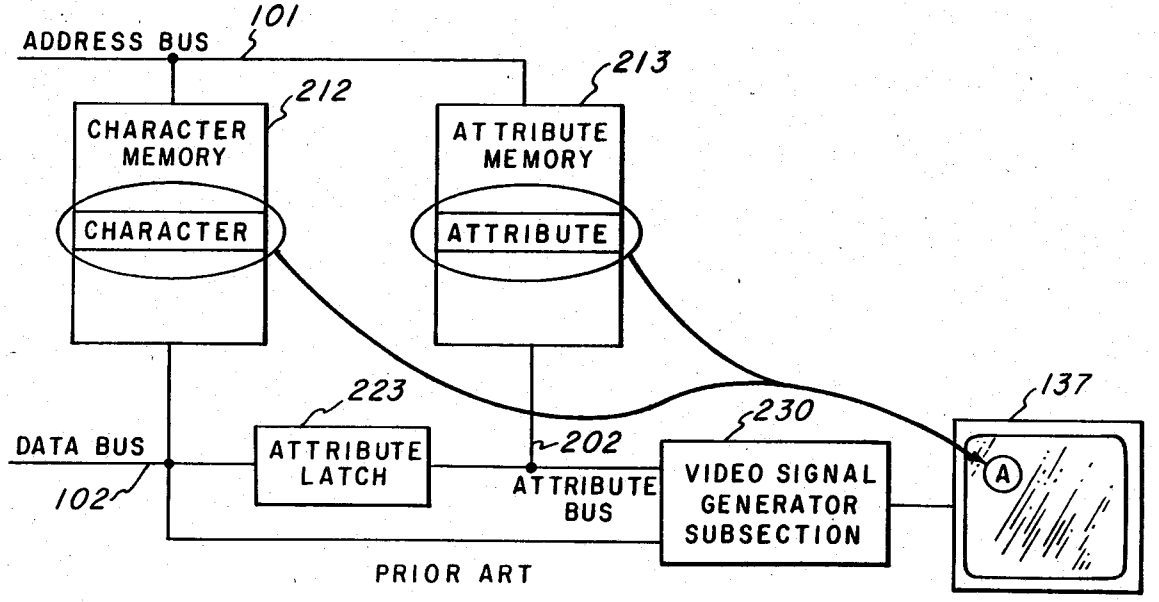
Fig. 3 PRIOR ART
FIG. 3 illustrates schematically the data flow during the sequence of normal video update in accordance with the prior art.

The normal screen update data flow known in the prior art is illustrated schematically in FIG. 3. The address selected by CRT control 222 is applied to character memory 212 and attribute memory 213. This particular address selects one of the data words stored within each of these two memories, as illustrated schematically in FIG. 3. The character data is applied to video signal generator subsection 230 via data bus 102 and the attribute data is applied to video signal generator subsystem 230 via attribute bus 202. Video signal generator subsystem 230 produces the video signal which produces a character at a particular position within monitor 137 corresponding to the character code recalled from character memory 212 with the video attributes corresponding to the attribute code recalled from attribute memory 213. This is illustrated schematically in FIG. 3.

Figure 4:
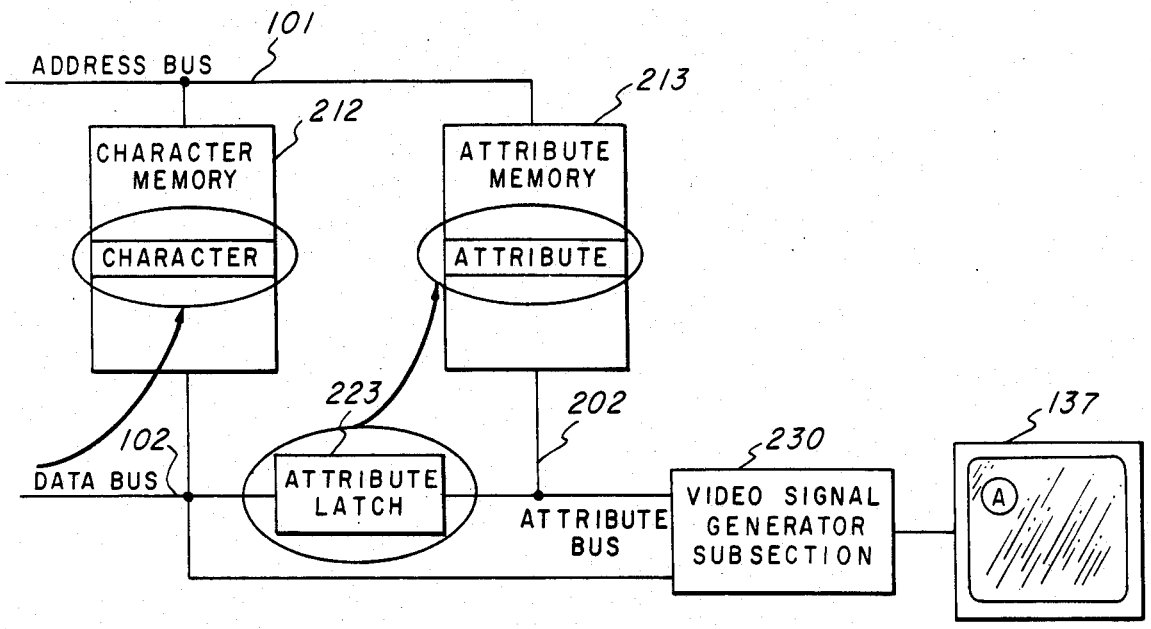
FIG. 4 illustrates schematically the data flow during a character code write operation in accordance with the present invention.
Figure 5:
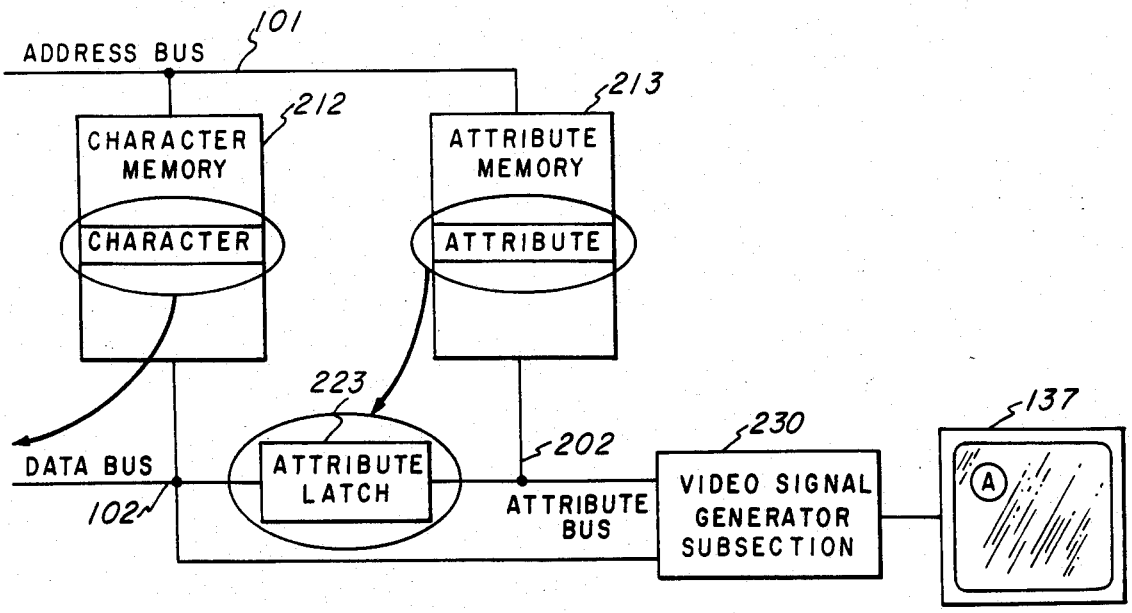
FIG. 5 illustrates schematically the data flow during a character code read operation in accordance with the present invention.
Figure 6:
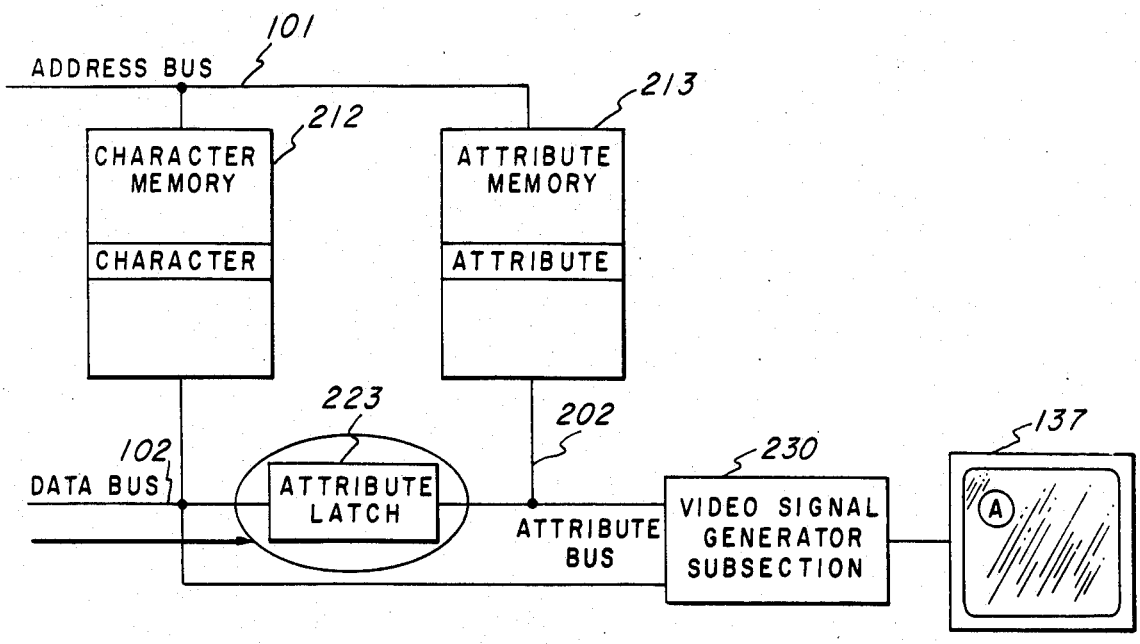
FIG. 6 illustrates schematically the data flow during an attribute code write operation in accordance with the present invention.
Figure 7:
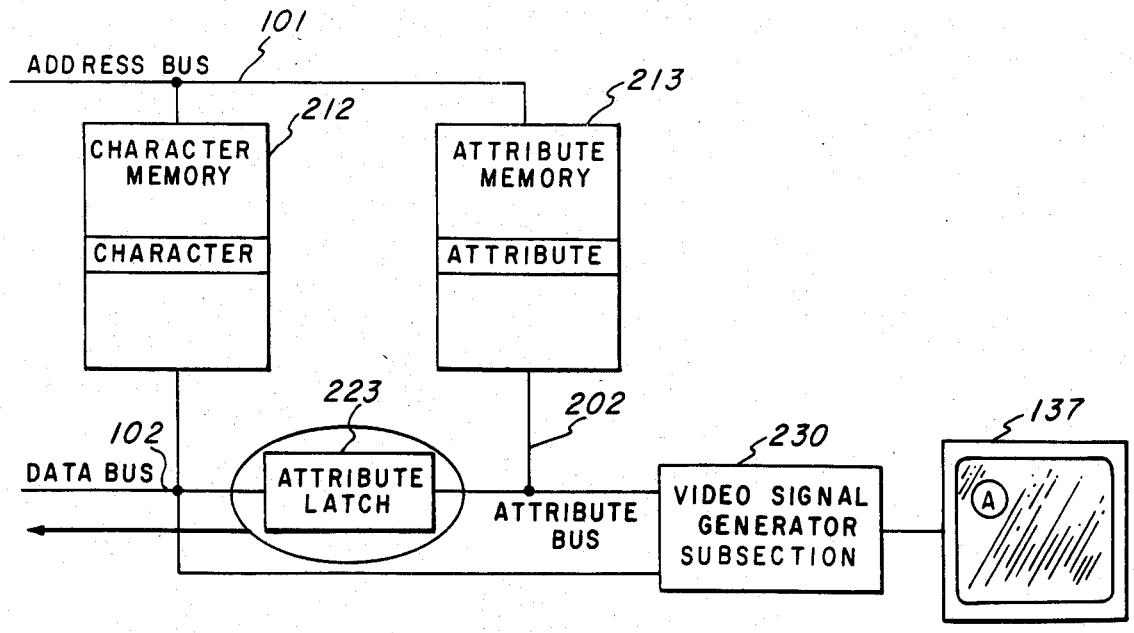
FIG. 7 illustrates schematically the data flow during an attribute code read operation in accordance with the present invention.

FIGS. 4–7 illustrates schematically the data flow between the processor subsection 110 (illustrated in FIG. 1) and character memory 212 and attribute memory 213 under various read and write conditions. FIG. 4 illustrates the data flow when processing subsection 110 writes into character memory 212, FIG. 5 illustrates the data flow when processing subsystem 110 reads from character memory 212. FIGS. 6 and 7 illustrate the data flow when writing to and reading from the attribute latch 223, respectively. It should be understood that all of the data transfers illustrated in FIGS. 4 to 7 are controlled by video display controller system decode logic 221 in response to signals received from processor subsection 110 via control bus 103.

FIG. 4 illustrates the data flow during a processing subsection 110 character code write operation. The address from address bus 101 specifies that particular memory location within both character memory 212 and attribute memory 213. The character code data appearing on data bus 102 is written into the specified location within character memory 212. In addition, the attribute data currently stored in attribute latch 223 is written into the specified portion of attribute memory 213 via attribute bus 202.

FIG. 5 illustrates the data flow during a processing subsystem 110 character code read operation. As noted above, the address appearing on address bus 101 selects a particular memory location within both character memory 212 and attribute memory 213. During a character code read operation, the character data stored within this specified location within character memory 212 is applied to data bus 102 and hence to processor subsection 110. In addition, the attribute data stored within the specified location within attribute memory 213 is written into the attribute latch 223 via attribute bus 202.

FIGS. 6 and 7 illustrate data flow during attribute code write and attribute code read operations, respectively. During an attribute code write operation, illustrated in FIG. 6, data from data bus 102 is stored in attribute latch 223. During an attribute code read operation, illustrated in FIG. 7, the data currently stored within attribute latch 223 is applied to data bus 102 for transfer to processing subsystem 110.

An attribute code read or write operation is optionally specified by processor subsection 110 in one of two preferred manners. Firstly, attribute latch 223 may be assigned a specific address for memory access. This particular address would be recognized by video display controller system decode logic 221. In the event of recognition of this particular address appearing on address bus 101, a subsequent read or write control signal from control bus 103 is interpreted by video display controller system decode logic 221 as a read or write operation to attribute latch 223. In the alternative, an attribute code write or read operation may be specified via control bus 103. In this event, video display controller system decode logic 221 recognizes the particular control state on control bus 101 which specifies an attribute code write or read operation regardless of the address appearing on the address bus 101.

The particular system outlined above employing attribute latch 223 is advantageous in reducing the data flow between processor subsystem 110 and video display controller 220 for forming most display screens. For example, typically it is not necessary to change the attribute for each new character to be stored within character memory 212. In such an event, the particular attribute for a set of characters to be stored within character memory 212 is first loaded into attribute latch 223 via an attribute code write operation. Thereafter the desired characters having this attribute are stored in the desired locations within character memory 212 via character code write operations. These character code write operations automatically write the attribute code stored within attribute latch 223 into the corresponding memory location within attribute memory 213. Only in the event in which a character is to be written into character memory 212 having a video attribute differing from the video attribute represented by the attribute code stored within attribute latch 223 would it be necessary to perform another attribute code write operation to update this attribute code. It is often possible to transfer a number of character codes into character memory 212 without changing the attributes of these characters, because the particular display screen desired requires the same attributes for these characters.

This system is also advantageous in some instances in which a character code read is required. This is particularly useful in an instance in which a block move of characters from one portion of the screen to another portion of the screen is desired. Such a block move of characters would require movement of a group of character codes stored within one portion of character memory 212 to another portion of character memory 212. In such an event each character may read from its old position using a character code read operation and then written into its new location using a character code write operation. Regardless of the order in which the characters are transferred, each time that a character code is read from character memory 212, its associated attribute code is written into attribute latch 223. Upon the subsequent character write into its new location within character memory 212 the attribute stored within attribute memory 223, corresponding to the attribute of the previously read character, is stored in the appropriate corresponding location within attribute memory 213. This system is advantageous because processing subsystem 110 now does not need to handle the attribute code but merely needs to transfer the character code. Thus, the amount of data needed to be handled by processor 110 is reduced and consequently this block move operation may be accomplished faster.

I claim:

1. A video display controller system comprising:

a character read/write memory means having a plurality of first memory locations, each first memory location corresponding to a video character position, for storing therein character codes corresponding to visual characters;

an attribute read/write memory means having a plurality of second memory locations, each second memory location corresponding to one of said first memory locations, for storing therein attribute codes corresponding to video attributes;

a video signal generator connected to said character read/write memory means and said attribute read/write memory means for reading character codes from first memory locations, reading attribute codes from corresponding second memory locations and generating a video signal having a plurality of video character positions, each video character position having a visual character corresponding to said character code read from said corresponding first memory location and having video attributes corresponding to the attribute code read from said corresponding second memory location;

a writing means connected to said character read/write memory means for writing a character code into a specified first memory location; and an attribute latch means connected to said attribute read/write memory means and said writing means, having an attribute code stored therein, for writing said attribute code stored therein into said second memory location corresponding to said specified first memory location simultaneously with the writing of said character code into said specified first memory location by said writing means.

2. A video display controller system as claimed in claim 1, further comprising:

an attribute writing means connected to said attribute latch means for writing an attribute code into said attribute latch means.

3. A video display controller system as claimed in claim 1, further comprising:

a reading means connected to said character read/write memory means for reading a character code from a specified first memory location; and wherein said attribute latch means is further connected to said reading means and said attribute latch means further includes means for reading the attribute code from said second memory location corresponding to said specified first memory location and storing said read attribute code therein simultaneously with the reading of said character code from said specified first memory location by said reading means.

4. A video display controller system as claimed in claim 3, further comprising:

an attribute reading means connected to said attribute latch means for reading said attribute code from said attribute latch means.

5. A video display controller system comprising:

a character read/write memory means having a plurality of first memory locations, each first memory location corresponding to a video character position, for storing therein character codes corresponding to visual characters;

an attribute read/write memory means having a plurality of second memory locations, each second memory location corresponding to one of said first memory locations, for storing therein attribute codes corresponding to video attributes;

a video signal generator connected to said character read/write memory means and said attribute read/write memory means for reading character codes from first memory locations, reading attribute codes from corresponding second memory locations and generating a video signal having a plurality of video character positions, each video character position having a visual character corresponding to said character code read from said corresponding first memory location and having video attributes corresponding to said attribute code read from said corresponding second memory location;

a reading means connected to said character read/write memory means for reading a character code from a specified first memory location; and an attribute latch means connected to said attribute read/write memory means and said reading means, having an attribute code stored therein, for reading the attribute code from said second memory location corresponding to said specified first memory location and storing said read attribute code therein simultaneously with the reading of said character code from said character read/write memory means by said reading means.

6. A video display controller system as claimed in claim 5, further comprising:

an attribute reading means connected to said attribute latch means for reading said attribute code from said attribute latch means.

7. A video display controller system as claimed in claim 5, further comprising:

a writing means connected to said character read/write memory means for writing a character code into a specified first memory location;

wherein said attribute latch means is further connected to said writing means and said attribute latch means further includes means for writing said attribute code stored therein into said second memory location corresponding to said specified first memory location simultaneously with the writing of said character code into said specified first memory location by said writing means; and an attribute writing means connected to said attribute latch means for writing an attribute code into said attribute latch means.

* * * * *